US009211727B2

(12) United States Patent
Sasaki

(10) Patent No.: US 9,211,727 B2
(45) Date of Patent: Dec. 15, 2015

(54) RECORDING APPARATUS

(75) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 13/332,155

(22) Filed: Dec. 20, 2011

(65) Prior Publication Data

US 2012/0162335 A1 Jun. 28, 2012

(30) Foreign Application Priority Data

Dec. 24, 2010 (JP) ..... 2010-288114

(51) Int. Cl.
*B41J 2/01* (2006.01)
*B41J 11/00* (2006.01)
*B41J 11/06* (2006.01)

(52) U.S. Cl.
CPC ..... *B41J 11/002* (2013.01); *B41J 11/06* (2013.01)

(58) Field of Classification Search
CPC ..... B41J 2/01; B41J 11/002; B41J 29/38
USPC ..... 347/102
See application file for complete search history.

(56) References Cited

U.S. PATENT DOCUMENTS

| | | | | |
|---|---|---|---|---|
| 624,470 A | | 5/1899 | Faust et al. | |
| 3,742,853 A | * | 7/1973 | Landsman | 101/401.1 |
| 5,411,825 A | * | 5/1995 | Tam | 430/41 |
| 5,986,682 A | * | 11/1999 | Itou | 347/171 |
| 2005/0168518 A1 | * | 8/2005 | Nishino | 347/29 |
| 2006/0140663 A1 | | 6/2006 | Matsuura | |
| 2009/0109269 A1 | * | 4/2009 | Rufes et al. | 347/102 |
| 2010/0033545 A1 | * | 2/2010 | Caiger et al. | 347/102 |
| 2012/0050434 A1 | * | 3/2012 | Hokazono | 347/102 |

FOREIGN PATENT DOCUMENTS

| | | |
|---|---|---|
| JP | 06-166177 | 6/1994 |
| JP | 10-323974 | 12/1998 |
| JP | 2000-225696 | 8/2000 |
| JP | 2005-324443 | 11/2005 |
| JP | 2006-189489 | 7/2006 |
| JP | 2006-224460 | 8/2006 |
| JP | 2007-083566 | 4/2007 |
| JP | 2010-089413 | 4/2010 |

OTHER PUBLICATIONS

Handbook of Chemistry, Lange's, 1979, McGraw-Hill, Thermodynamic Properties, p. 9-169, Table C, Aluminum Oxide.*

* cited by examiner

*Primary Examiner* — Julian Huffman
(74) *Attorney, Agent, or Firm* — Workman Nydegger

(57) ABSTRACT

A recording apparatus includes: a recording head that ejects fluid onto a recording medium; a supporting member that supports the recording medium; and a heating device that heats the supporting member, in which a supporting surface that supports the recording medium in the supporting member has a surface treatment layer having a radiation factor of 0.85 or more.

6 Claims, 3 Drawing Sheets

RECORDING APPARATUS

The entire disclosure of Japanese Patent Application No: 2010-288114, filed Dec. 24, 2010 is expressly incorporated by reference herein in its entirety.

BACKGROUND

1. Technical Field

The present invention relates to a recording apparatus.

2. Related Art

An ink jet printer is known as a type of recording apparatus that records images or characters by ejecting fluid onto a recording medium. In the ink jet printer, when ink (fluid) that needs permeation drying or evaporation drying is used, there is need for a heating device to be provided to dry the ink ejected on the recording medium.

An ink jet recording apparatus disclosed in JP-A-2000-225696 is known as such a recording apparatus. The ink jet recording apparatus employs a section equipped with an infrared heater to heat the rear side of the recording surface of a recording medium and an infrared reflecting member at a position opposite to the infrared heater, and indirectly supplies infrared energy to the recording medium by using reflection. Further, it is preferable that the emissivity (radiation factor) of the infrared reflecting member be equal to or less than 0.1 when employing the unit.

However, the section in JP-A-2000-225696 does not directly supply infrared energy onto the recording surface of a recording medium, such that energy loss occurs and the ink may solidify and adhere to the nozzle due to radiation of the infrared energy to the nozzle plate that is ink ejecting portion. Further, in the section in JP-A-2000-225696, thermal responsiveness is poor particularly at the infrared reflecting member, a large amount of power is necessary to increase the temperature to a predetermined level, and it takes time for the heat to dissipate after being used.

SUMMARY

An advantage of some aspects of the invention is to provide a low power recording apparatus having a superior thermal responsiveness.

According to an aspect of the invention, there is provided a recording apparatus including: a recording head that ejects fluid onto a recording medium; a supporting member that supports the recording medium; and a heating device that heats the supporting member, in which a supporting surface that supports the recording medium in the supporting member has a surface treatment layer having a radiation factor of 0.85 of more.

According to the configuration, the supporting member having a surface treatment layer having a radiation factor of 0.85 or more on the supporting surface supporting the recording medium is heated. When the supporting member is a heat-receiving side, heat storage effect is achieved in the surface treatment layer due to heat absorption, contributing to a reduction in start-up time and power savings. On the contrary, when the supporting member is a heat-discharging side, heat discharging performance is increased by the radiation factor of the surface treatment layer and thermal responsiveness is improved.

Further, in the apparatus, the heating device may be disposed at a position opposite to the surface treatment layer and may include a radiation-heating unit that radiation-heats the surface treatment layer.

According to the configuration, since the radiation heating unit is disposed opposite to the surface treatment layer, it is possible to radiation-heat the surface treatment layer of the supporting member and also to directly heat the recording medium, thereby reducing energy loss.

Further, in the apparatus, the radiation heating unit may include an infrared heater having a wavelength which includes a region of 2 to 4 μm at the main portion of the peak of a radiation spectrum.

According to another aspect of the invention, absorption efficiency of infrared energy in water molecules is increased and radiation heating is implemented with a wavelength which includes a region of 2 to 4 μm at the main portion of a peak of a radiation spectrum, such that it is possible to vibrate the water molecules contained in the fluid, such as ink, and rapidly encourage drying due to the friction heat, without significantly increasing the temperature of the peripheral members which do not contain water molecules.

Further, the surface treatment layer may have a black alumite-processed layer.

According to still another aspect of the invention, the radiation factor of the surface treatment layer is 0.85 or more by the black alumite process.

Further, the heating device may be disposed on a surface opposite to the supporting surface of the supporting member and may include a heat-transfer/heating unit that transfers heat to the supporting member.

According to still another aspect of the invention, the heat-transfer/heating unit that transfers heat from the surface opposite to the supporting surface is provided, other than the radiation heating unit, such that the temperature of the support member is managed.

Further, the recording head may be disposed at a position opposite to the surface treatment layer.

According to still another aspect of the invention, since the recording head is disposed at the same side as the radiation heating unit, it is possible to prevent the fluid ejecting unit from being heated and the fluid from thickening and sticking.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
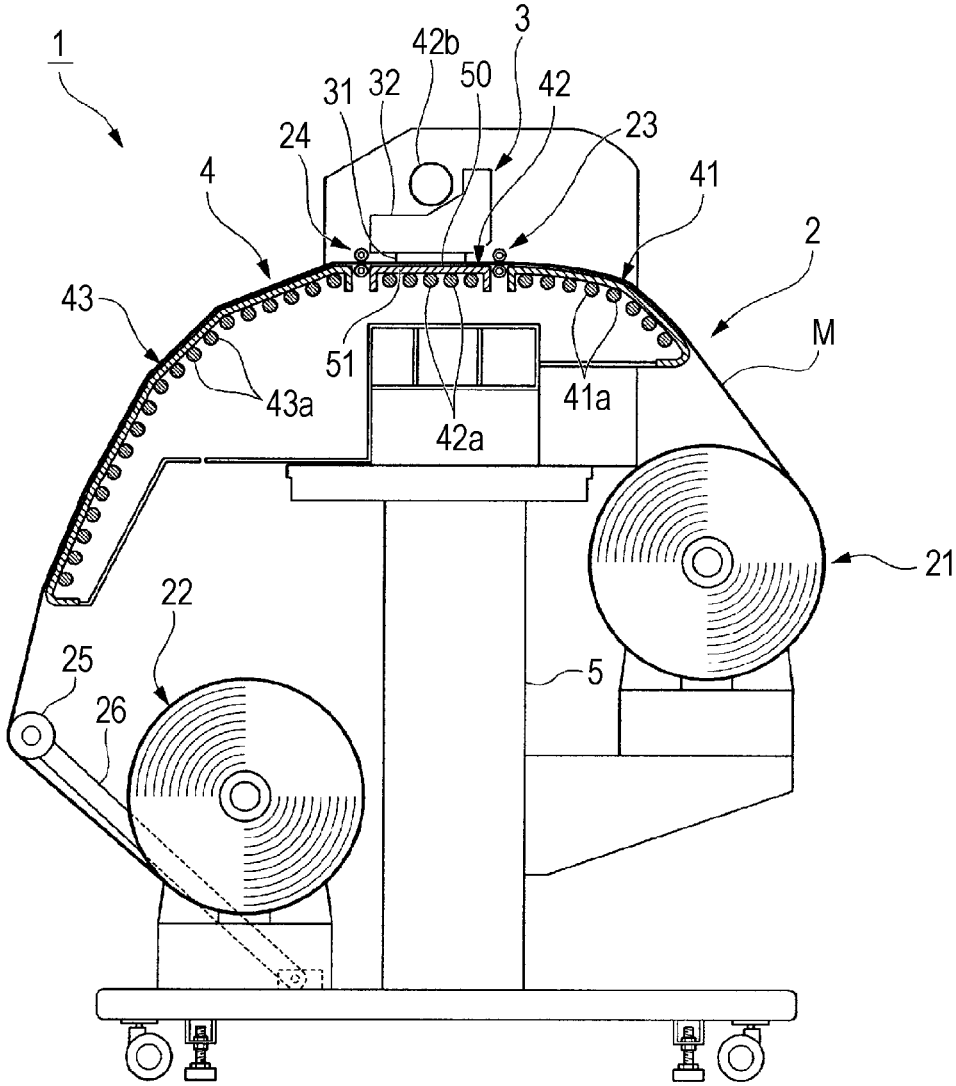
FIG. 1 is a view showing the configuration of a printer according to an embodiment of the invention.

Embodiments of a recording apparatus of the invention are described with reference to the drawings. Further, the scales of the members are appropriately changed such that the members can be recognized in the drawings used for the following description. An ink jet type printer (hereafter, simply referred to as a printer) is exemplified in the embodiment as a recording apparatus of the invention.

FIG. 1 is a view showing the configuration of a printer 1 according to an embodiment of the invention.

The printer 1 is a large format printer (LFP) handling relatively large media (recording media) M. The medium M of the embodiment is implemented by a vinyl chloride series having a width of, for example, 64 inches.

As shown in FIG. 1, the printer 1 includes a transporting unit (transporting device) 2 that transports the medium M in a roll-to-roll method, a recording unit 3 that records images or characters by ejecting ink (fluid) onto the medium M, and a heating unit (heating device) 4 that heats the medium M. The units are supported by a main body frame 5.

The transporting unit 2 includes a roll 21 that discharges a rolled medium M and a roll 22 that winds the discharged medium M. The transporting unit 2 includes a pair of transporting rollers 23 and 24 that transport the medium M on a transporting path between the rolls 21 and 22. Further, the transporting unit 2 includes a tension roller (tensing device) 25 that applies tension to the medium M on the transporting path between the paired transporting roller 24 and the roll 22.

The tension roller 25 is supported by an oscillation frame 26, in contact with the rear side of the medium M in the width direction (perpendicular to the page in FIG. 1). The tension roller 25 is formed longer in the width direction than the width of the medium M. The tension roller 25 is disposed further to the downstream side in the transporting direction than the after-heater unit 43 of the heating unit 4, which is described below.

The recording unit 3 includes an ink jet head (recording head) 31 that ejecting ink (fluid) onto the medium M on the transporting path between the pair of transporting rollers 23 and 24 and a carriage that is equipped with the ink jet head 31 and freely reciprocates 32 in the width direction. The ink jet head 31 has a plurality of nozzles and can eject ink that needs permeation drying or evaporation drying, which was selected based on the relationship with the medium M.

The heating unit 4 heats the medium M, thus preventing bleeding and blurring and improves the image quality by rapidly drying and fixing the ink on the medium M. The heating unit 4 has a supporting surface that is a portion of the transporting path of the medium M, and heats the medium M on the supporting surface while bending and supporting the medium M protruding upward between the rolls 21 and 22.

The heating unit 4 includes a preheater unit 41 that preheats the medium M further to the upstream side in the transporting direction from the position where the recording unit 3 is disposed, a platen heater unit 42 that heats the medium M, opposite to the recording unit 3, and an after-heater unit 43 that heats the medium M further to the downstream side in the transporting direction from the position where the recording unit 3 is disposed.

In the embodiment, heating temperature of the heater 41*a* in the preheater unit 41 is set at 40° C. Further, in the embodiment, heating temperature of a heater 42*a* in the platen heater unit 42 is set at 40° C. (the desired treatment), the same as in the heater 41*a*. Further, in the embodiment, heating temperature of a heater 43*a* in the after-heater unit 43 is set at 50° C., higher than that of the heaters 41*a* and 42*a*.

The preheater unit 41 rapidly dries the ink from when the ink lands by gradually increasing the temperature of the medium M to a desired temperature (the temperature of the platen heater unit 42) from room temperature. Further, the platen heater unit 42 allows the ink to land on the medium M with the desired temperature maintained, and encourages the ink to dry rapidly from when the ink lands.

Further, the after-heater unit 43 rapidly dries the remaining ink that lands on the medium M and not dried yet by increasing the temperature of the medium M higher than the desired temperature, and completely dries and fixes the placed ink onto the medium M at least before the medium is wound on the roll 22.

Next, a characteristic configuration of the platen heater unit 42 according to the embodiment is described with reference to FIGS. 2 to 4B.

Figure 2:
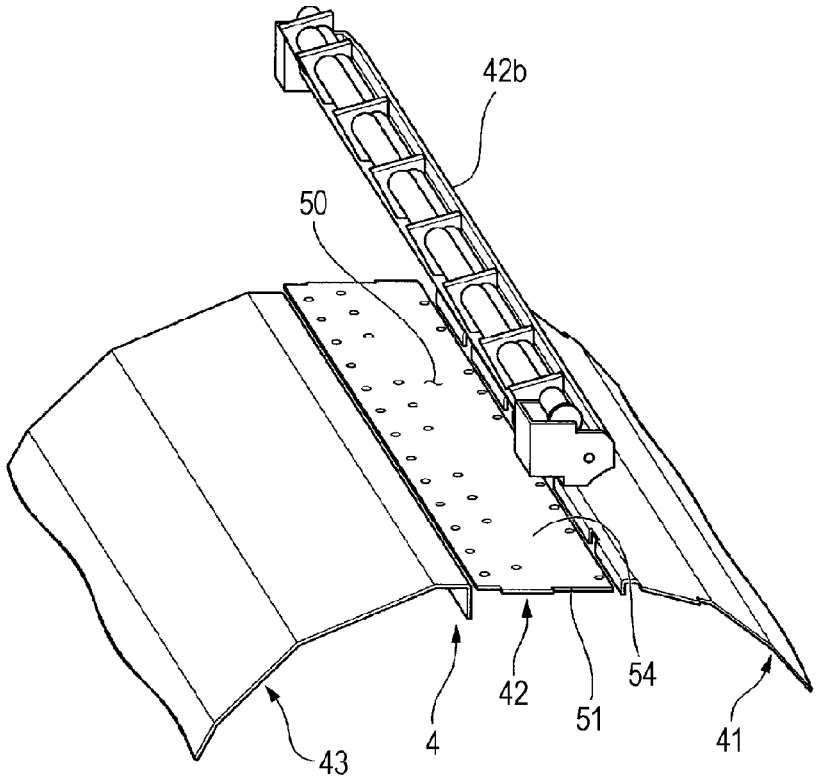
FIG. 2 is a perspective view showing the configuration of a platen heater unit according to an embodiment of the invention.
Figure 3:
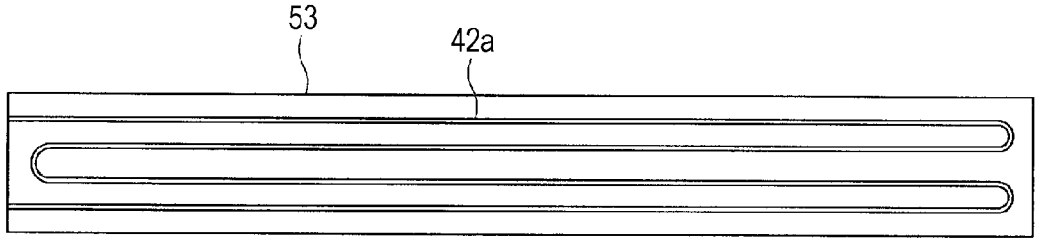
FIG. 3 is a plan view showing the configuration of a heater according to an embodiment of the invention.
Figure 4A:
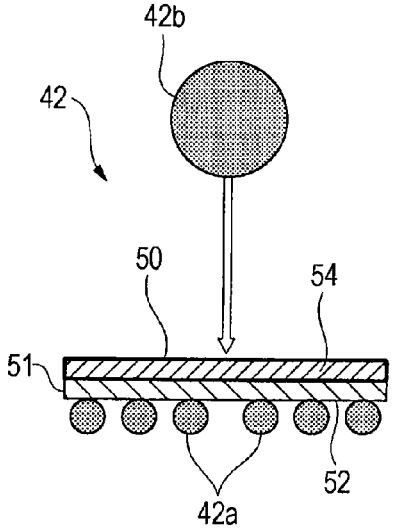
FIGS. 4A and 4B are schematic views illustrating the operation of a platen heater unit according to an embodiment of the invention.
Figure 4B:
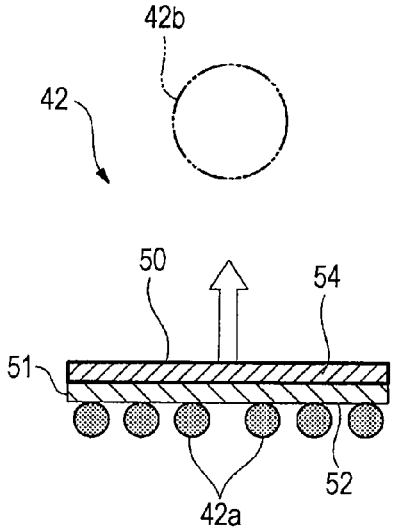

FIG. 2 is a perspective view showing the configuration of the platen heater unit 42 according to an embodiment of the invention. FIG. 3 is a plan view showing the configuration of the heater 42*a* according to an embodiment of the invention. FIGS. 4A and 4B are schematic views illustrating the operation of the platen heater unit 42 according to an embodiment of the invention.

As shown in FIG. 2, the platen heater unit 42 has a platen (supporting member) 51 having a supporting surface 50 supporting the medium M. The platen 51 is made of a metallic material, such as an Al material or an SUS material. The platen 51 of the embodiment is made of an Al material. The platen 51 is longer in the width direction than the width of the medium M and, in more detail, has a flat plate shape that is longer than a width of about 64 inches.

The heater 42*a* (heat-transfer/heating unit) shown in FIG. 3 is wired on the surface 52 (see FIGS. 4A and 4B) opposite to the supporting surface 50 of the platen 51. As shown in FIG. 3, the heater 42*a* is a tube heater and bonded to the opposite surface 52 of the platen 51 by an aluminum tape 53. Therefore, the heater 42*a* transfers heat to the platen 51 by thermal conduction from the opposite surface 52 and indirectly heats the medium M supported on the supporting surface 50 from the rear side.

The heater 42*b* shown in FIG. 2 (radiation-heating unit) is disposed at the position opposite to the supporting surface 50 of the platen 51. The heater 42*b* is an infrared heater and extends in the width direction of the platen 51, at a predetermined distance from the supporting surface 50. Therefore, the heater 42*b* radiation-heats the platen 51 by directly radiating infrared energy on the supporting surface 50 and directly radiation-heats the recording surface side of the medium M when the medium M is supported on the supporting surface 50.

The heater 42*b* radiates electromagnetic waves having a wavelength which includes a region of 2 to 4 μm at the main portion of a peak of a radiation spectrum. Therefore, the heater 42*b* can vibrate the water molecules contained in the ink and rapidly dry the ink by using the friction heat, without increasing temperature of the peripheral components that do not contain water molecules. Accordingly, it is possible to intensively heat the ink landed on the recording surface rather than the medium M by absorbing most of the infrared energy into the ink.

The ink jet head 31 (see FIG. 1) is disposed at the position opposite to the supporting surface 50. The ink jet head 31 has a positional relationship that it is disposed between the supporting surface 50 and the heater 42*b*, and is mounted on the carriage 32 to reciprocate in the width direction therebetween. Accordingly, infrared energy is not radiated to the nozzle plate that is the ink discharge portion of the ink jet head 31, such that it is possible to prevent the ink from solidifying and adhering to the nozzle. Further, as a thermal countermeasure, the carriage 32 is provided with, for example, an insulator, because infrared energy is radiated thereto.

As shown in FIGS. 4A and 4B, the supporting surface 50 of the platen 51 has a surface treatment layer 54 having a radiation factor of 0.85 or more. The surface treatment layer 54 in the embodiment is formed by applying a black alumite process to a surface of the platen 51 made of an Al material. Specifically, the surface treatment layer 54 has a black alumite-processed layer formed by applying a black delustering alumite process.

Further, when the platen 51 is made of another metallic material, such as mild steel (radiation factor: 0.05) or stainless steel (radiation factor: 0.1), it is possible to make the radiation factor at 0.85 or more by using a surface coating process (for example, a black lacquer process). Further, a ceramic coating may be employed as the surface coating process.

As shown in FIG. 4A, when a heating source (for example, heater 42*b*) having temperature that is equal to or more than the temperature of the platen 51 is provided, the platen 51 is a heat-receiving side for the radiation energy. Due to the radiation factor of the surface treatment layer 54, the temperature rising effect of the platen 51 that is a heat-receiving side is increased, such that the temperature of the platen 51 is increased to predetermined temperature and the medium M on the platen 51 can be heated using a small amount of power.

As shown in FIG. 4B, when a heating source (for example, heater 42*b*) having a temperature that is equal to or more than the temperature of the platen 51 is turned off or not provided, the platen 51 is a heat-discharging side for the radiation energy. The surface treatment layer 54, due to the radiation factor thereof, increases the radiation energy discharged to the periphery of the platen 51 that is a heat-discharging side and increases the heat-discharging effect to more than the normal state, such that it is possible to provide superior thermal responsiveness.

Further, when the entire platen 51 is made of a heat storage material, the response to the discharging of heat is deteriorated. However, when only the supporting surface 50 of the platen 51 is the surface treatment layer 54, the heat storage effect is achieved only in operation (for example, when the heater 42*b* is turned on) while conversely, the heat discharging effect is achieved in non-operation, such that a mechanism having high thermal response is implemented.

As known in the related art, the relationship between radiation energy E, radiation factor $\epsilon$, and temperature T is expressed as the following Formula 1. Further, $\sigma$ is the Stefan-Boltzmann constant.

$$E=\epsilon\times\sigma\times T^4 \quad (1)$$

As expressed by Formula 1, the radiation energy is proportionate to the radiation factor and fourth power of the temperature, such that contribution of the radiation factor is large. Accordingly, it is necessary to make the radiation factor of the surface treatment layer 54 at 0.85 or more in order to achieve the operation described above. On the other hand, when the radiation factor of the surface treatment layer 54 is less than 0.85, the operation is insufficient.

Figure 5:
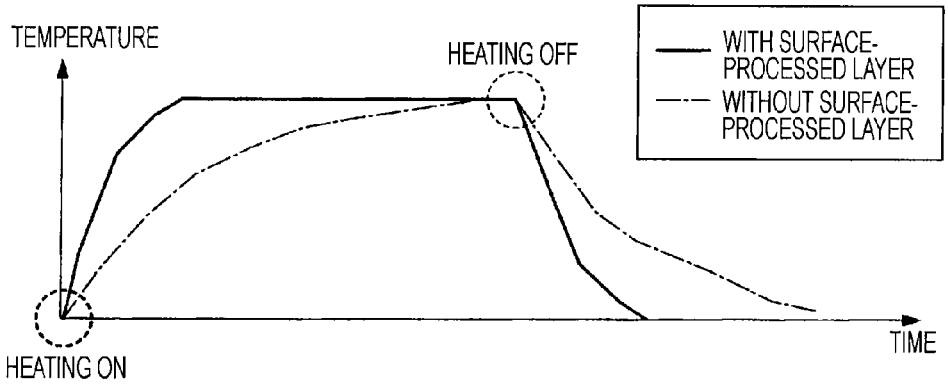
FIG. 5 is a graph illustrating heating and temperature rising effect of a platen according to an embodiment of the invention.

Next, the operation of the platen heater unit 42 having the configuration described above and the heating and temperature rising effect of the platen 51 are described with further reference to FIG. 5.

FIG. 5 is a graph illustrating heating and temperature rising effect of the platen 51 according to an embodiment of the invention. Further, the vertical axis is temperature and the horizontal axis is time in FIG. 5. Further, the chain line indicates a temperature change of the platen 51 of the related art without the surface treatment layer 54 in FIG. 5.

When a job instruction to start printing is input, the heating sources (heaters 42*a* and 42*b*) are driven in the platen heater unit 42 and the temperature of the platen 51 is increased to a predetermined temperature (40° C. in the embodiment) from the room temperature. In the platen 51, the supporting surface 50 is radiation-heated by the heater 42*b* and the opposite surface 52 receives heat and is heated via thermal conduction by the heater 42*a*. In the process, since the platen 51 is a heat-receiving side with temperature lower than the heat sources, heat storage effect due to absorption of heat of the surface treatment layer 54 is achieved and the temperature can rapidly reach predetermined temperature. Accordingly, as clearly seen in comparison to the configuration without the surface treatment layer 54 shown in FIG. 5, it is possible to contribute to a reduction in the start-up time and saving of power.

When the medium M is transported to the printing region on the supporting surface 50, the printing by the ink jet head 31 is started. In this operation, it becomes difficult for the platen 51 to receive heat from the heater 42*b* because the supporting surface 50 is covered by the medium M, but the temperature is kept constant by receiving the heat from the heater 42*a*.

The ink jet head 31 is mounted on the carriage 32 and starts printing while reciprocating in the width direction. Since the heater 42*b* is disposed across the width direction above the carriage 32, when the carriage 32 retracts from the ink-landing region, the ink-landing region is directly radiation-heated with a wavelength which includes a region of 2 to 4 μm at the main portion of the peak of a radiation spectrum. Accordingly, the water molecules contained in the placed ink vibrate, encouraging evaporation drying by the friction heat, and the ink is fixed without into the medium M without bleeding or the like occurring.

Since the heater 42*b* is disposed opposite to the surface treatment layer 54, the surface treatment layer 54 of the platen 51 can be radiation-heated and the medium M can also be directly heated, thereby reducing energy loss. Further, since the ink jet head 31 is also disposed at the same side as the heater 42*b*, it is possible to avoid the nozzle plate from being heated and the ink from thickening and sticking, as happens in the related art.

When a finish print job instruction is input, the heating sources (heaters 42*a* and 42*b*) in the platen heater unit 42 are stopped and the temperature of the platen 51 is decreased from the predetermined temperature to the room temperature. In this process, since the platen 51 is a heat-discharging side with temperature higher than the periphery, the surface treatment layer 54, due to the radiation factor thereof, increases the radiation energy discharged in the periphery of the platen 51, thereby increasing the heat discharging effect. Accordingly, as clearly seen in comparison to the configuration without the surface treatment layer 54 shown in FIG. 5, thermal responsiveness is superior. Therefore, after the print job is finished, the temperature of the platen 51 rapidly decreases, such that it is possible to immediately adjust the temperature of the medium M to an appropriate temperature, for example, even if the material or size of the next-printed medium M is changed.

Therefore, according to the embodiment described above, in the printer 1 including an ink jet head 31 ejecting ink onto the medium M, the platen 51 supporting the medium M, and heaters 42*a* and 42*b* heating the platen 51, the support surface 50 supporting the medium M of the platen 51 employs the configuration having the surface treatment layer 54 having a radiation factor of 0.85 or more, such that when the platen 51 is a heat-receiving side, heat storage effect is achieved in the surface treatment layer 54 by heat absorption and it is possible contribute to a reduction in start-up time and to save power, whereas when the platen 51 is a heat-discharging side, heat discharging performance is increased by the radiation factor of the surface treatment layer 54 and thermal responsiveness is improved.

Therefore, a low power printer 1 having a high thermal responsiveness is achieved in the embodiment.

Although a preferred embodiment of the invention was described above with reference to the drawings, the invention is not limited to the embodiment. The shapes or the combination of the components shown in the embodiment are an example and they may be changed in various ways on the basis of the desired design without departing from the spirit of the invention.

For example, in the embodiment, it is exemplified when the surface treatment layer 54 is disposed at the platen 51 of the platen heater unit 42, but the surface treatment layer 54 may be disposed at the supporting member of another portion (for example, the preheater unit 41 or the after-heater unit 43).

In the embodiment, although it is exemplified when the recording apparatus is the printer 1, the recording apparatus is not limited to printers and may be a copy machine or a facsimile or the like.

Further, a recording apparatus that ejects or discharges another fluid, other than ink, may be employed as the recording apparatus. The invention may be used for various recording apparatuses including a recording head that discharges a small amount of droplets, for example. Further, droplets mean the state of fluid discharged from the recording apparatus, including a particle shape, a tear shape, and ones with a string-shaped tail. Further, the fluid should be a material that the recording apparatus can eject. For example, the material should be in a liquid state, like a fluid state such as: fluid with high or low viscosity, sol, gel water, other inorganic solvents, organic solvents, solution, liquid-state resin, liquid-state metal (metallic melt), including not only liquid as one state of the material, but a substance where particles of a functional material made of solid materials, such as a colorant or metal particles are dissolved, dispersed, or mixed in a solvent. Further, the ink described in the embodiment may be a typical example of the fluid. The ink includes various fluid compounds, such as common aqueous ink, oil-based ink, gel ink, and hot-melt ink. Further, the recording medium includes paper sheet, functional paper, substrate, and metal plate, other than plastic films, such as a vinyl chloride series-based film.

What is claimed is:

1. A recording apparatus comprising:

a recording head that ejects fluid onto a recording medium;

a supporting member that supports the recording medium; and a heating device that heats the supporting member, wherein a supporting surface that supports the recording medium in the supporting member has a surface treatment layer having a radiation factor of 0.85 or more, wherein the surface treatment layer contacts with the recording medium when the supporting member supports the recording medium, wherein the heating device includes a radiation heating unit that radiation heats the surface treatment layer from above the treatment layer and a heat-transfer heating unit that transfers heat to the surface treatment layer from below the surface treatment layer, wherein when the radiation heating unit provides radiation heating energy to the top of the surface treatment layer and the heat-transfer heating unit provides heating energy to the bottom of the surface treatment layer, the surface treatment layer acts as a heat receiving side for the radiation heating energy that thereby heats the supporting member by absorbing and storing the heating energy, and wherein when the radiation heating unit does not provide radiation heating energy to the surface treatment layer, the surface treatment layer acts as a heat discharging side that discharges heat energy that was absorbed and stored when the heating energy was provided.

2. The recording apparatus according to claim 1, wherein the radiation-heating unit includes an infrared heater having a wavelength which includes a region of 2 to 4 μm at the main portion of a peak of a radiation spectrum.

3. The recording apparatus according to claim 1, wherein the surface treatment layer has a black alumite-processed layer.

4. The recording apparatus according to claim 1, wherein the heating device is disposed on a surface opposite to the supporting surface of the supporting member.

5. The recording apparatus according to claim 1, wherein the recording head is disposed at a position opposite to the surface treatment layer.

6. A recording apparatus comprising:

a recording head that ejects fluid onto a recording medium;

a supporting member that supports the recording medium; and a heating device that heats the supporting member, wherein a supporting surface that supports the recording medium in the supporting member has a surface treatment layer having a radiation factor of 0.85 or more, wherein the heating device includes an infrared heater having a wavelength which includes a region of 2 to 4 μm at the main portion of a peak of a radiation spectrum and a heat-transfer heating unit, wherein the infrared heater is disposed opposite to the surface treatment layer and heats the surface treatment layer from above the treatment layer and the heat-transfer heating heats the surface treatment layer from below the surface treatment layer, wherein when the infrared heater provides radiation heating energy to the top of the surface treatment layer and the heat-transfer heating unit provides heating energy to the bottom of the surface treatment layer, the surface treatment layer acts as a heat receiving side for the heating energy that thereby heats the supporting member by absorbing and storing the heating energy, and wherein when the infrared heater does not provide radiation heating energy to the surface treatment layer, the surface treatment layer acts as a heat discharging side that discharges heat energy that was absorbed and stored when the heating energy was provided.

* * * * *